US006635006B2

(12) United States Patent
Auerbach et al.

(10) Patent No.: US 6,635,006 B2
(45) Date of Patent: Oct. 21, 2003

(54) ADJUSTABLE BUCKLE CHUTE FOLDING MACHINE

(75) Inventors: David R Auerbach, West Redding, CT (US); William J. Wright, Killingworth, CT (US)

(73) Assignee: Pitney Bowes Inc., Stamford, CT (US)

( * ) Notice: Subject to any disclaimer, the term of this patent is extended or adjusted under 35 U.S.C. 154(b) by 0 days.

(21) Appl. No.: 10/035,630

(22) Filed: Oct. 26, 2001

(65) Prior Publication Data

US 2003/0083184 A1 May 1, 2003

(51) Int. Cl.[7] ..... B31F 1/00

(52) U.S. Cl. ..... 493/419; 493/420; 493/421; 493/476

(58) Field of Search ..... 493/419, 420, 493/421, 475, 478, 476

(56) References Cited

U.S. PATENT DOCUMENTS 3,583,295 A * 6/1971 Elder et al. ..... 493/18
3,804,399 A * 4/1974 Rupp ..... 493/421
5,180,357 A 1/1993 Marzullo
5,322,498 A 6/1994 Lehmann et al.
5,352,177 A 10/1994 Walter
5,514,066 A * 5/1996 Monaco ..... 493/25
5,520,603 A 5/1996 Bluthardt et al.
5,769,774 A * 6/1998 Beck et al. ..... 493/421
5,967,963 A 10/1999 Gotting
6,024,682 A * 2/2000 Mandel et al. ..... 493/23

* cited by examiner

*Primary Examiner*—Eugene Kim
(74) *Attorney, Agent, or Firm*—Michael J. Cummings; Charles R. Malandra, Jr.; Angelo N. Chaolas

(57) ABSTRACT

A buckle chute having a stop to cause a sheet of document entering the buckle chute to buckle for making a folded edge. The ends of stop are threadably engaged with two lead screws, which are mechanically linked together by a chain, so that the lead screws can be simultaneously turned in order to adjust the position of both ends of the stop. Each end of the stops has a split nut with grooves for engaging with the threads of the lead screws. The split nut can be disengaged from the threads so that the position of one or both ends of the stop can be adjusted.

9 Claims, 10 Drawing Sheets

ADJUSTABLE BUCKLE CHUTE FOLDING MACHINE

FIELD OF THE INVENTION

The present invention relates generally to a folding machine for folding one or more sheets of document into a folded piece and, more particularly, to a buckle chute.

BACKGROUND OF THE INVENTION

Folding machines are well-known. For example, U.S. Pat. No. 4,701,233 (Beck et al.) discloses a method of folding a sheet by bulging a portion of the sheet and then folding the bulged portion through a roller nip. U.S. Pat. No. 4,875,965 (Marzullo) discloses a folding apparatus wherein a buckle chute is used for stopping a sheet, causing the sheet to enter a roller nip for folding. U.S. Pat. No. 4,944,131 (Gough) also discloses a folding apparatus having a buckle chute. In general, the sheet is allowed to enter into a channel of the buckle chute until the leading edge of the sheet is stopped by a stop. The leading edge stays in contact with the stop while the bulged portion is moved toward the roller nip for making a folded edge. The distance between the folded edge and the leading edge is usually adjustable. In the past, the buckle chute must first be removed from the folding machine and then the stop must be manually adjusted so as to change the distance between the folded edge and the leading edge. A series of markings indicating the folding distance are provided on the buckle chute to aid the positioning of the stop. While the folding distance can be roughly estimated by the markings, a precise folding distance is difficult to achieve. To obtain the correct folding distance, one may have to taking the buckle chute out of the folding machine a number of times to adjust the stop.

It is advantageous and desirable to provide a buckle chute wherein the folding distance can be precisely adjusted without the need of removing the buckle chute from the folding machine.

SUMMARY OF THE INVENTION

The present invention is concerned with a buckle chute having a front side, a back side, a left side and a right side for use in a sheet folding apparatus having a first driving mechanism and a second driving mechanism for folding at least one sheet of paper, having first and second lateral edges defining a width, into a folded piece of the same width, the first and the second lateral edges adjacent the left and right sides of the turn chute. The buckle chute is disposed between the first driving mechanism and the second driving mechanism and comprises:

an upper guide and a lower guide for forming a channel having an entry point on the front side of the buckle chute adjacent to the first driving mechanism;

a stop, disposed in the channel between the front side and the back side at a separation length from the entry point, for stopping a leading edge of said at least one sheet or the folded piece entering the channel from advancing further into the channel toward the back side so as to cause said at least one sheet or the folded piece to buckle at a locality thereof outside the entry point of the channel toward the second driving mechanism for forming a folded edge at the buckled locality by the second driving mechanism as the first driving mechanism continues driving said at least one sheet or the folded piece toward the buckle chute; and an adjustment mechanism, mechanically engaged with the stop, for moving the stop toward the front side or the back side for adjusting the separation length.

According to the present invention, it is possible that the buckle chute further comprises a deflector mechanism, disposed near the entry point of the channel and operable in a first position, for allowing the leading edge of the said at least one sheet or the folded piece to enter into the channel when said at least one sheet or the folded piece is driven by the first driving mechanism toward the entry point of the buckle chute, or in a second position, for preventing the leading edge of said at least one sheet or the folded piece from entering the channel and further directing the leading edge toward the second driving mechanism.

According to the present invention, the adjustment mechanism comprises a screw system threadably engaged with the stop for moving the stop. The stop has a left end and a right end adjacent the left side and the right side of the turn chute, and the screw system comprises a first lead screw disposed near the left side for operatively engaging with the left end of the stop, and a second lead screw disposed near the right side for operatively engaging with the right end of the stop, and wherein the first and second lead screws are mechanically linked to each other such that the first and second lead screws can be caused to turn simultaneously for moving both ends of the stop by a substantially equal distance for adjusting the separation length.

According to the present invention, each end of the stop has an engagement mechanism for threadably engaging with the respective lead screw so that each end of the stop can be independently disengaged from the respective lead screw.

According to the present invention, the engagement mechanism comprises a split nut having grooves for engaging with the threads on the respective lead screw. In particular, the engagement mechanism comprises a first mount fixedly mounted to the first end of the stop; a second mount, movably mounted to the first end of the stop adjacent to the first mount, for fixedly mounting the split nut, wherein the second mount can be caused to move relative to the first mount to disengage the grooves of the split nut from the threads for disengaging one end of the stop from the respective lead screw.

According to the present invention, a spring is mounted between the first mount and the second mount for urging the split nut against the lead screw so as to firmly engage the grooves with the threads.

The present invention will become apparent upon reading the description taken in conjunction with FIGS. 1 to 8*d*.

DETAILED DESCRIPTION OF THE INVENTION

Figure 1:
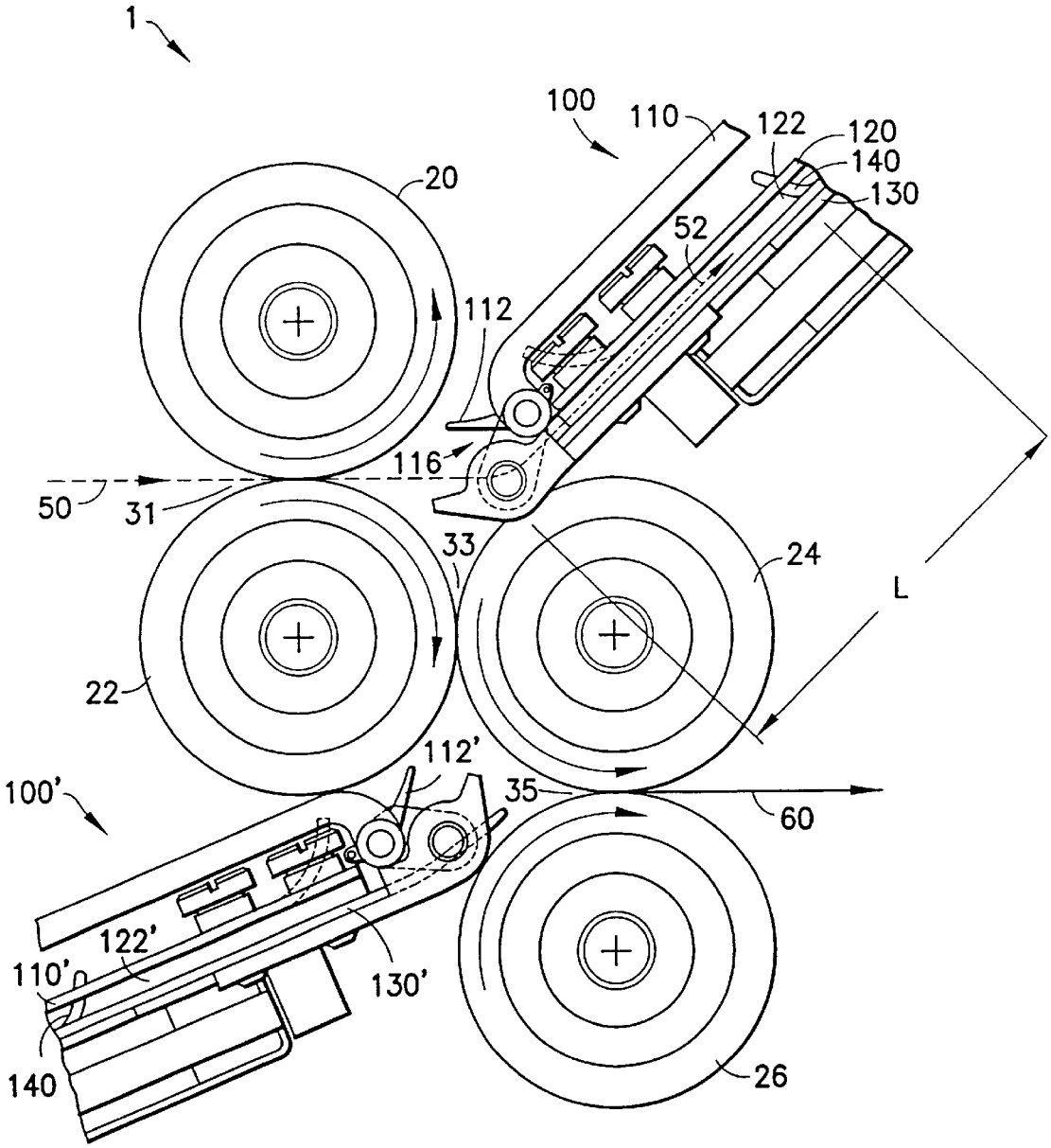
FIG. 1 is a diagrammatic representation illustrating a folding apparatus having two buckle chutes.

FIG. 1 is a schematic representation of a folding apparatus 1. As shown, the folding apparatus 1 has two buckle chutes 100, 100' positioned among three roller nips 31, 33 and 35. The roller nip 31 is formed by rollers 20 and 22, the roller nip 33 is formed by rollers 22 and 24, and the roller nip 35 is formed by rollers 24 and 26. The buckle chute 100 is positioned adjacent to the roller nips 31 and 33, and the buckle chute 100' is positioned adjacent to the roller nips 33 and 35. The number of buckle chutes determines how many folded edges a folding apparatus is capable of making on a sheet of document. However, the number of folded edges made on a sheet by the folding apparatus can be less than the number of buckle chutes in the folding apparatus. As shown in FIG. 1, the first buckle chute 100 and the second buckle chute 100' are similar, except that they are oriented differently. The buckle chute 100 has an upper guide 120 and a lower guide 130 forming therebetween a channel 122. A sheet 10 (FIGS. 2*a* and 2*b*) entering the folding apparatus 1 along an input path 50 is driven by the roller nip 31 toward the entry point 116 of the buckle chute 100. The sheet 10 is guided by the upper guide 120 and the lower guide 130 to enter the channel 122 along a direction 52. A stop 140 is provided in the channel 122 to prevent the sheet 10 from advancing further into the buckle chute 100. The distance L between the stop 140 and the entry point 116 determines the distance between the leading edge 40 and the folded edge 42 (FIGS. 3*a*–3*c*) made by the roller nip 33. The distance L can be adjusted by repositioning the stop 140 toward or away from the entry point 116. The folded piece 18 (FIG. 5*a*–5*b*) exits along an exit path 60.

Figure 2A:
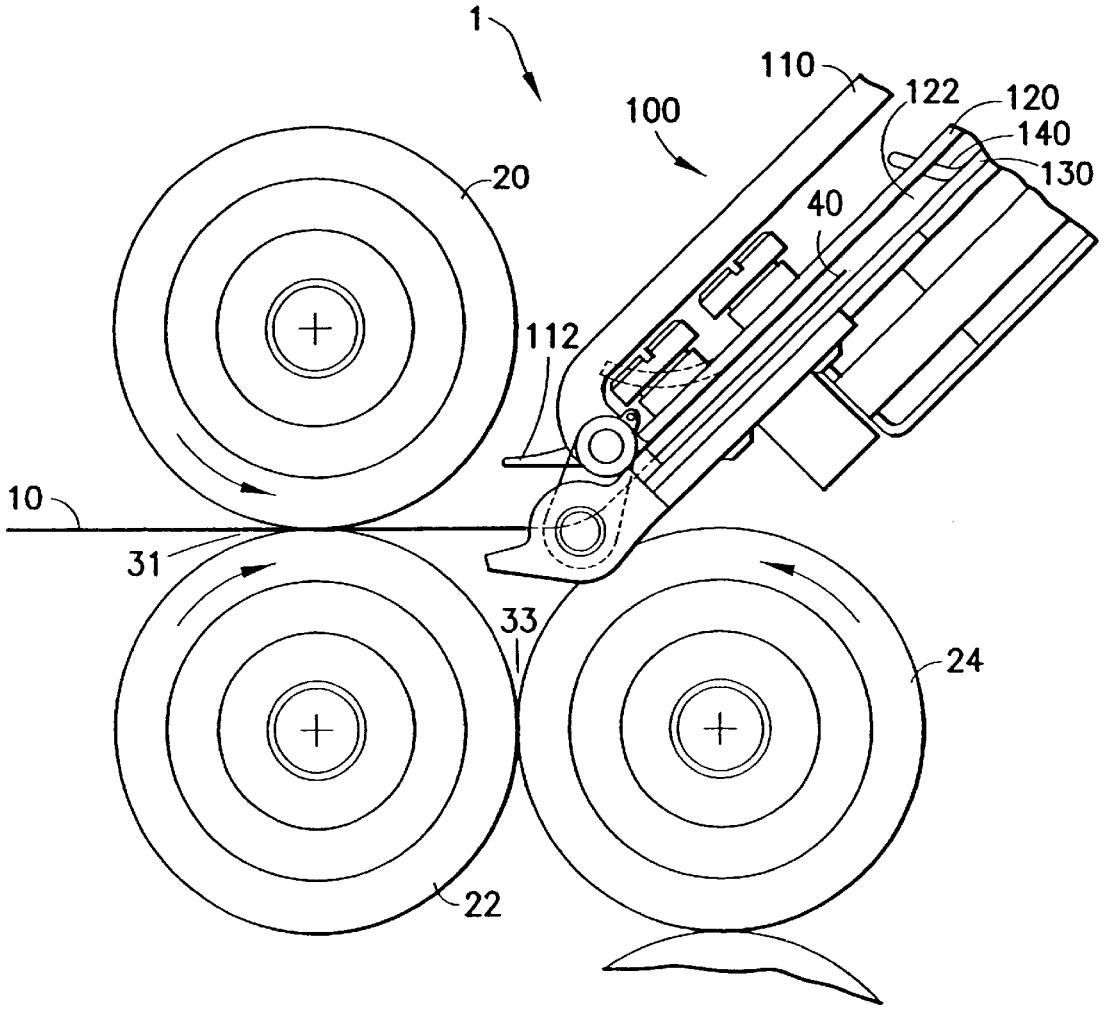
FIG. 2*a* is a diagrammatic representation illustrating the deflector on the buckle chute being opened to allow a sheet of document to enter into the channel of the buckle chute.
Figure 2B:
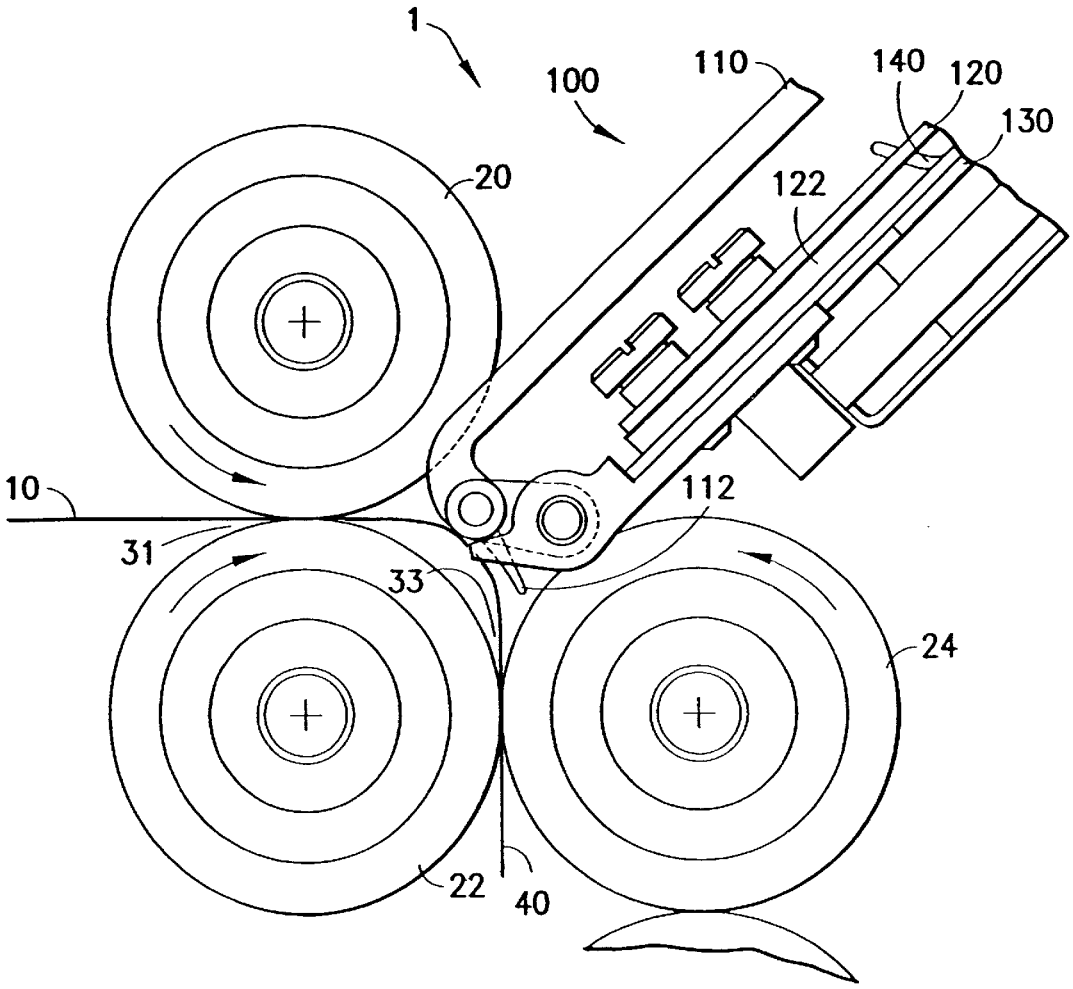
FIG. 2*b* is a diagrammatic representation illustrating the deflector being closed to deflect the sheet away from the buckle chute.

The buckle chute 100 has a deflector 112, located near the entry point 116. The deflector 112, controlled by an actuator arm 110, is operable either in an open position or in a closed position. As shown in FIG. 2*a*, the deflector 112 is operated in the open position to allow the leading edge 40 of the sheet 10 to enter into the channel 122 of the buckle chute 100. As shown in FIG. 2*b*, the deflector 112 is operated in the closed position, preventing the sheet 10 from entering the buckle chute 100. As such, the leading edge 40 of the sheet 10 is deflected toward the roller nip 33. The sheet 10 is further driven by the roller nip 33 toward the buckle chute 100'. The deflector mechanism maybe the same as the one described in co-pending patent application No. 10/029776, (Attorney Docket F-384) entitled BUCKLE CHUTE FOLDING MACHINE WITH DEFLECTOR CONTROL MECHANISM, by David Auerbach and William Wright, filed concurrently with this application, and which is hereby incorporated by reference in its entirety.

Figure 3A:
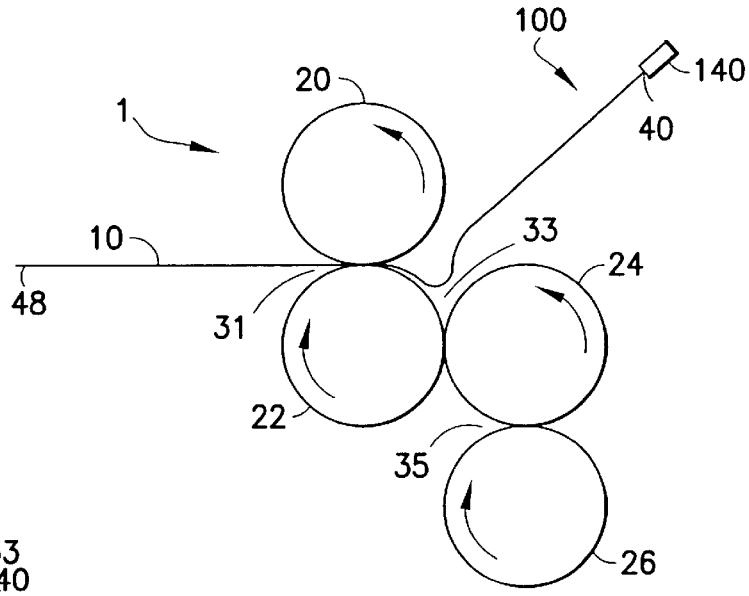
FIG. 3*a* is a diagrammatic representation illustrating a buckled portion being formed on a sheet of document.
Figure 3B:
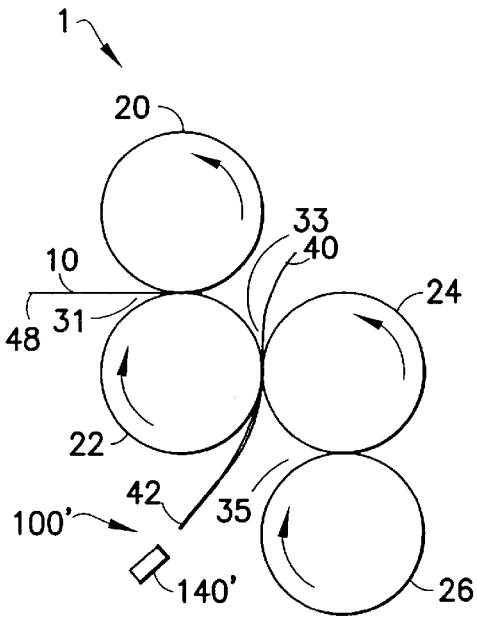
FIG. 3*b* is a diagrammatic representation illustrating the buckled portion being folded into a folded edge.
Figure 3C:
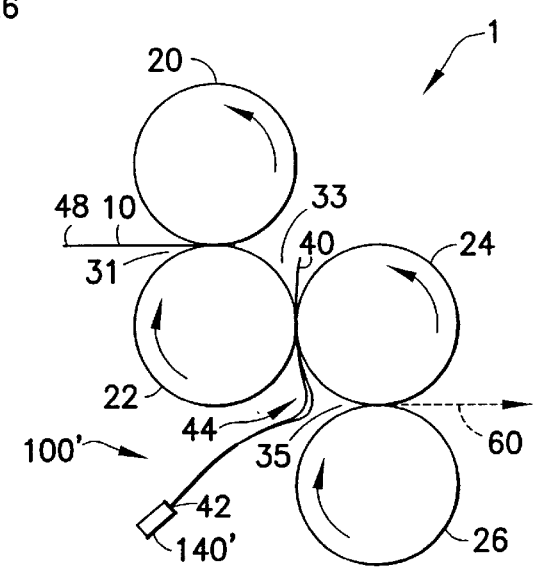
FIG. 3*c* is a diagrammatic representation illustrating a second buckled portion being formed on the folded sheet.
Figure 5A:
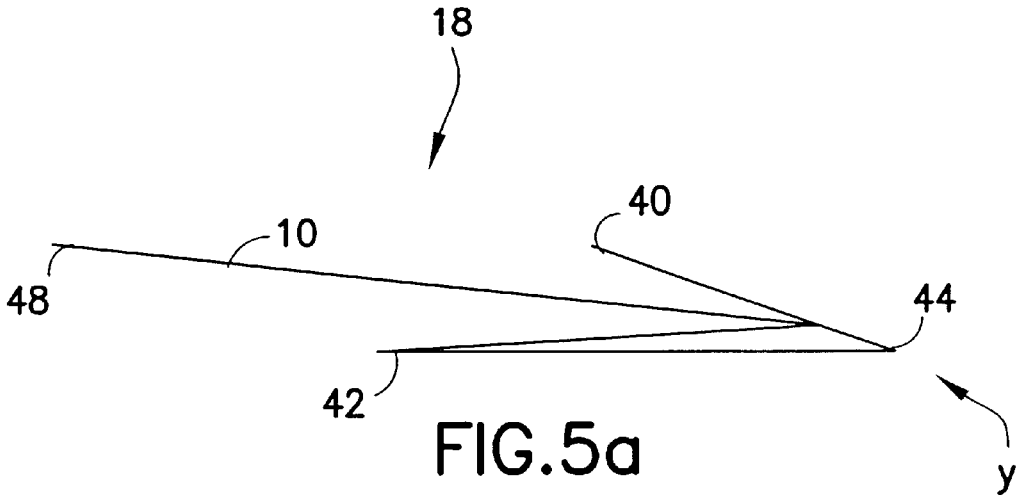
FIG. 5*a* is a diagrammatic representation illustrating a folded piece resulted from the folding arrangement, as shown in FIGS. 3*a*–3*c*.

FIGS. 3*a*–3*c* show how the sheet 10 is folded into a folded piece 18 (FIG. 5*a*). As shown in FIG. 3*a*, the deflector 112 of the buckle chute 100 is operated in the open position, allowing the leading edge 40 of the sheet 10 to reach the stop 140. As the rollers 20 and 22 keep driving the sheet 10 toward the buckle chute 100, they cause a portion of the sheet to buckle. The buckled portion is further moved toward the nip 33 and drawn into the nip 33. A folded edge 42 is thus formed by the nip 33, as shown in FIG. 3*b*. FIG. 3*c* illustrates the folded edge 42 entering into the buckle chute 100' and being stopped by the stop 140' of the buckle chute 100' for making a second folded edge 44 by the nip 35. After the sheet 10 exits the nip 35 along the exit path 60, it becomes a folded piece 18, as shown in FIG. 5*a*. Reference numeral 48 denotes the trailing edge of the sheet 10. The distance between the leading edge 40 and the folded edge 42 is determined by the distance L between the stop 140 in the buckle chute 100 and the entry point 116, but it is also determined by the distance from the entry point 116 to the nip 33. It is desirable that the position of the stop 140 can be adjusted in fine steps so that the precise distance between the leading edge 40 and the folded edge 42 can be achieved. As shown in FIGS. 6–8*d*, the present invention uses two lead screws 170, 172 to adjust the position of the stop 140, relative to the entry point 116. The adjustment precision is determined by the threads 176 on the lead screws 170, 172.

Figure 4A:
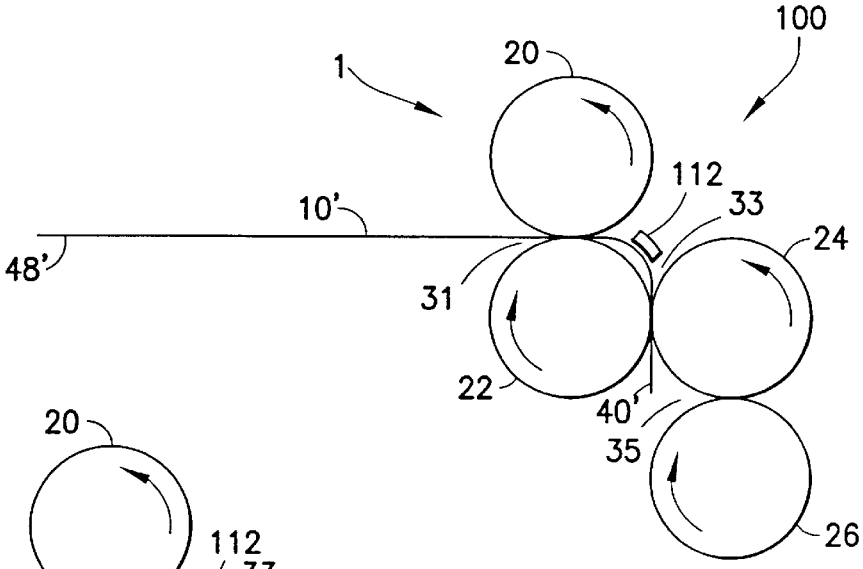
FIG. 4*a* is a diagrammatic representation illustrating the leading edge of a sheet being deflected away from the first buckle chute.
Figure 4B:
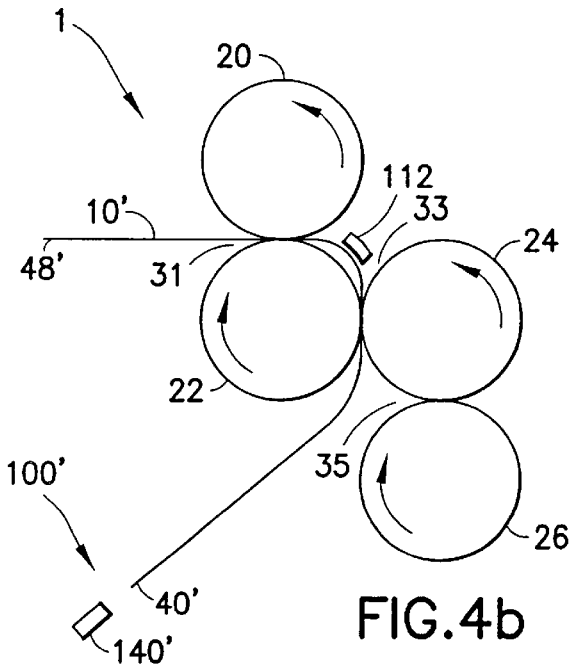
FIG. 4*b* is a diagrammatic representation illustrating the leading edge of the sheet entering the second buckle chute.
Figure 4C:
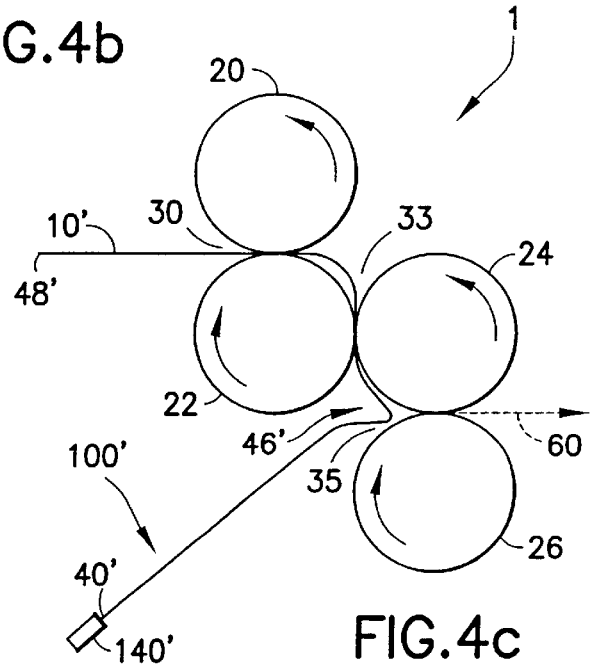
FIG. 4*c* is a diagrammatic representation illustrating a buckled portion of the sheet being formed.
Figure 5B:
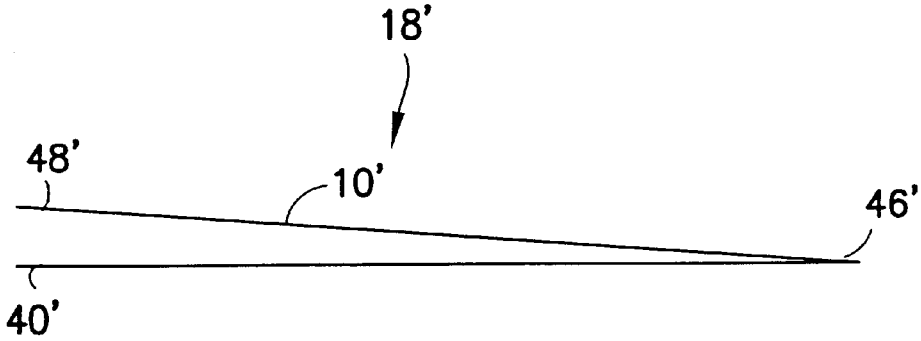
FIG. 5*b* is a diagrammatic representation illustrating a folded piece resulted from the folding arrangement, as shown in FIGS. 4*a*–4*c*.

If the deflector 112 of the buckle chute 100 is operated in the closed position, a sheet 10' driven into the folding apparatus 1 by the nip 31 is deflected by the deflector 112, as shown in FIG. 4*a*. The leading edge 40' of the sheet 10' is drawn into the nip 33 and moved into the buckle chute 100', as shown in FIG. 4*b*. While the leading edge 40' of the sheet 10' is stopped by the stop 140' of the buckle chute 100', the rollers 20, 22 and 24 keep advancing the sheet 10' into the folding apparatus 1. As a result, the sheet 10' is buckled and the buckled portion is moved toward the nip 35 for making a folded edge 46'. After the sheet 10' exits the nip 35 along the exit path 60, it becomes a folded piece 18', as shown in FIG. 5*b*.

Figure 6B:
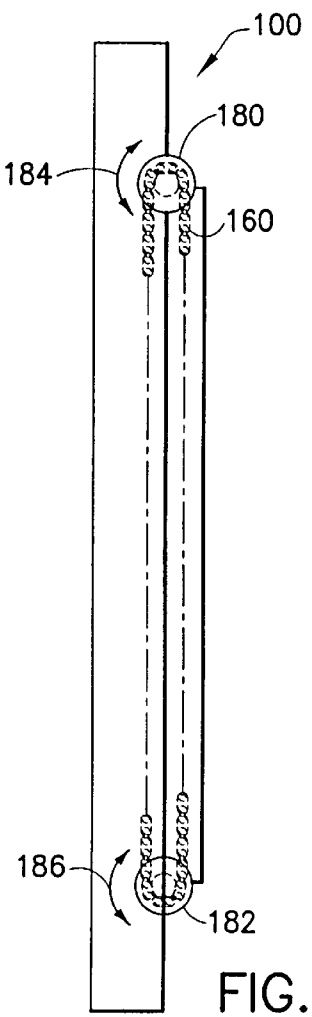
FIG. 6*b* is a rear view of the buckle chute showing the screw system.
Figure 6A:
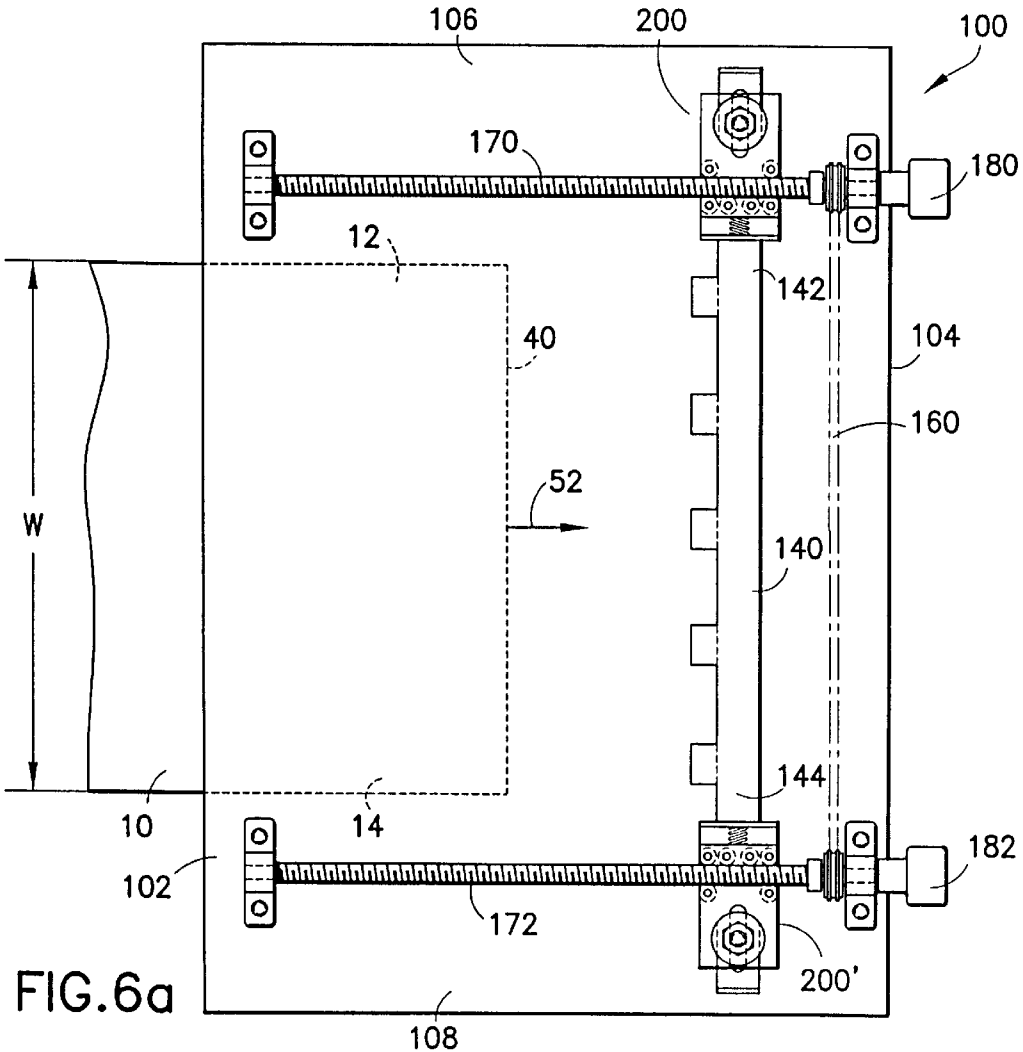
FIG. 6*a* is a top view of the buckle chute showing the screw system for adjusting the position of the stop.

The present invention provides a buckle chute, wherein the position of the stop can be adjusted in fine steps without the buckle chute being removed from the folding apparatus. As shown in FIG. 6*a*, the buckle chute 100 has a front side 102, a back side 104, a left side 106, and a right side 108. The buckle chute 100 has two lead screws 170, 172, positioned adjacent and substantially parallel to the left and right sides 106, 108, for mounting the stop 140. In particular, the stop 140 has a left end 142 and a right end 144, each attached to an engagement mechanism 200, 200'. The lead screws 170, 172 are mechanically linked by a chain 160, as shown in FIG. 6*b*. Two adjustment knobs 180, 182 are fixedly attached to the lead screws 170, 172 for turning the lead screws. When either of the adjustment knobs 180, 182 is turned, both lead screws 170, 172 are simultaneously turned in the same direction about the rotation axes 184, 186. The engagement mechanisms 200, 200' are threadably engaged with the lead screws 170, 172 in the same manner such that the engagement mechanisms 200, 200 are moved by the same amount along the lead screws 170, 172 in the same direction toward the back side 104 or the front side 102. If the stop 140 of the buckle chute 100 is set up such that it is substantially perpendicular to the left and right sides 106, 108, the stop 140 remains perpendicular to the left and right sides 106, 108 after it is caused to moved toward the back side 104 or the front side 102 by the lead screws 170, 172.

Lead screws 170, 172 allow manual adjustment of the stop 140 without removing the buckle chute. The screws also lock the stop 140 in place so that it doe not move upon impact of sheets 10. For example, a system utilizing a rotary belt to adjust the stop 140 would be subject to pressure on the belt that might cause it to rotate and allow the stop 140 to move.

As shown in FIG. 6*a,* a sheet 10, having lateral edges 12, 14 defining a width W, enters into the buckle chute 100 along the direction 52. It is desirable that the sheet 10 enters the buckle chute 100 with the lateral edges 12, 14 being perpendicular to the stop 140. If the nips 31, 33 are also parallel to the stop 140, then the folded edge 42 formed by the nip 31 should be substantially parallel to the leading edge 40. In that case, the sheet 10 is folded at right angles with regard to the lateral edges 12, 14. As will be described in conjunction with FIGS. 8*a*–8*c,* each of the engagement mechanisms 200, 200' can be independently disengaged from the respective lead screw 170, 172. As such, the position of each end 142, 144 of the stop 140 can be independently adjusted so that the stop 140 is substantially parallel to the nips 31 and 33.

In the case that the sheet 10 enters the buckle chute 100 in a slightly skewed manner, resulting in a less desirable folded piece 18 in that the folded edges are not perpendicular to the lateral edges, it is possible to independently adjust the engagement mechanisms 200, 200' to correct for this slight defect. Furthermore, while it is useful to turn the adjustment knobs 180, 182 to precisely adjust the position of the stop 140 in small steps, it is also possible to disengage both the engagement mechanisms 200, 200' from the lead screws 170, 172 so that the stop 140 can be moved to a different position, relative to the entry point 116, in a large step.

Figure 7:
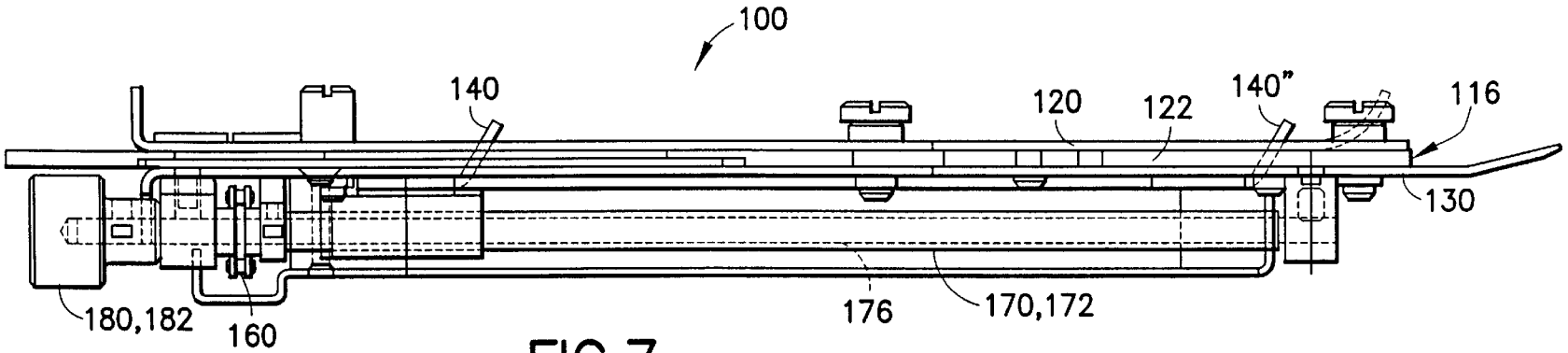
FIG. 7 is a side view of the buckle chute, omitting the deflector mechanism.

FIG. 7 is a side view of the buckle chute 100 showing the different position of the stop 140, relative to the entry point 116. As shown, the stop 140 can be moved to a new position, as denoted by reference numeral 140", closer to the front side 102.

Figure 8A:
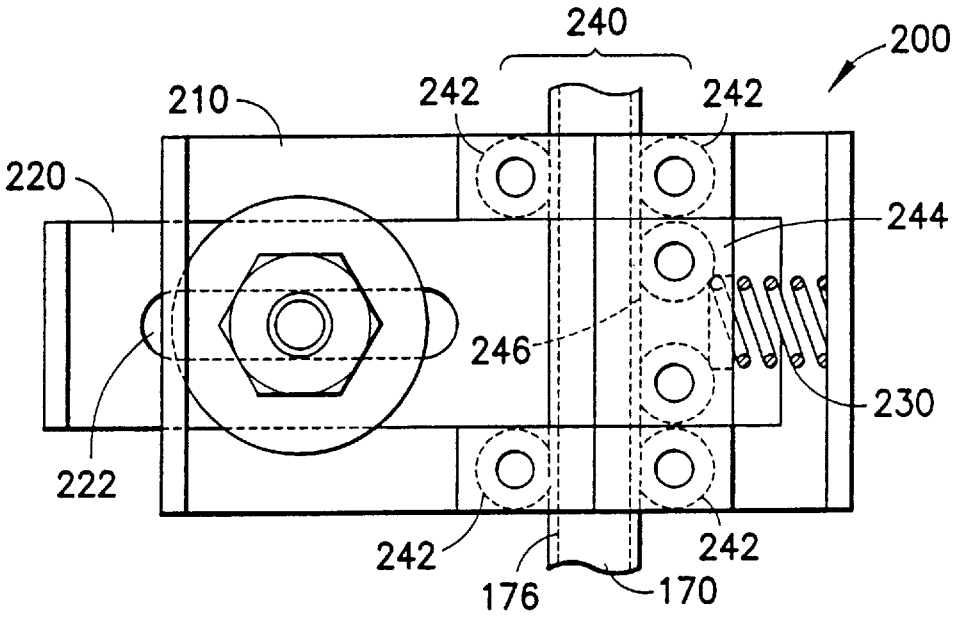
FIG. 8*a* is a top view of a split nut arrangement.
Figure 8B:
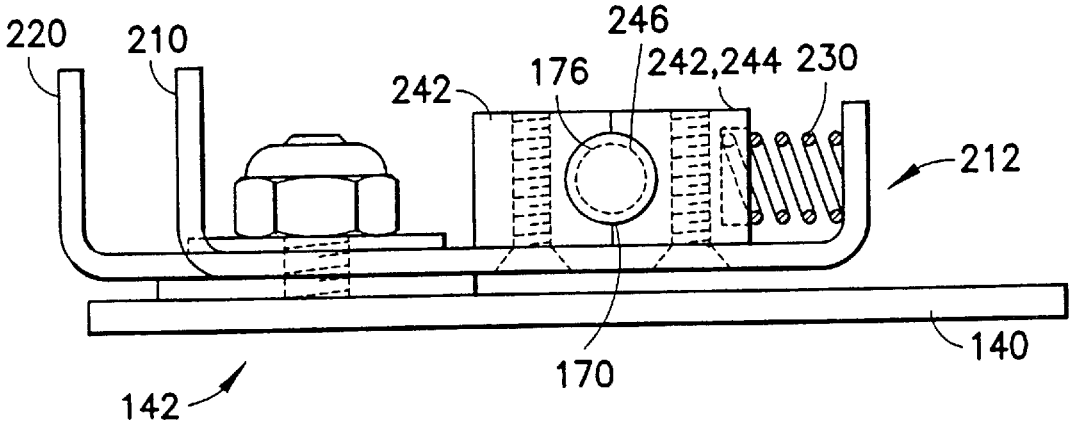
FIG. 8*b* is a side view of the split nut arrangement.
Figure 8C:
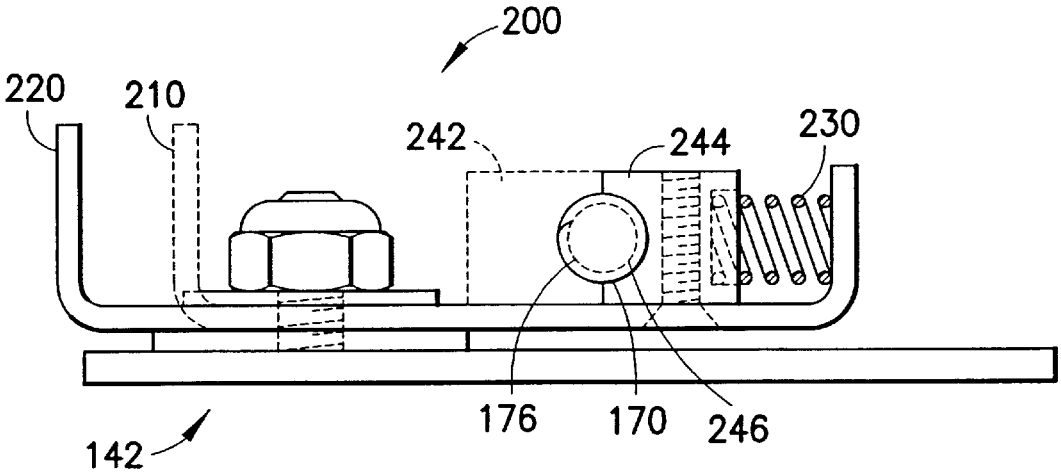
FIG. 8*c* is side view showing the split nut being engaged with a lead screw.
Figure 8D:
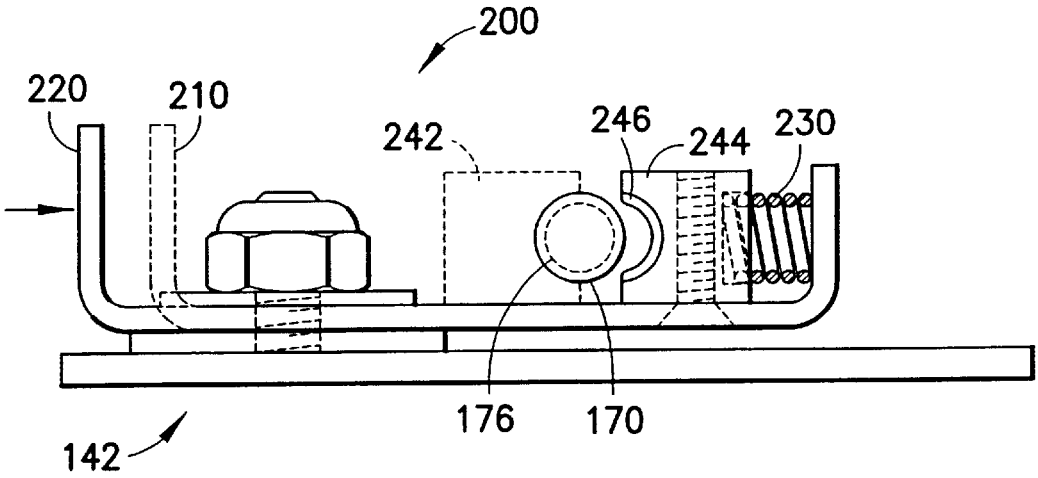
FIG. 8*d* is a side view showing the split nut being disengaged from the lead screw.

FIGS. 8*a* to 8*d* show the detail of the engagement mechanism 200. As shown in FIG. 8*a* and 8*b,* the engagement mechanism 200 has a first mount 210, which is fixedly mounted to the stop 140, and a second mount 220, which is movably mounted to stop 140. The second mount 220 has a slot 222, allowing the second mount 220 to be moved toward or away from the lead screw 170. As shown in FIG. 8*a,* a split nut 240 has four side portions 242 fixedly mounted on the first mount 210 around the lead screw 170, and a center portion 244 fixedly mounted on the second mount 220. The center portion 244 has grooves or threads 246 matching with the threads 176 on the lead screw 170. A spring 230, mounted between the center portion 244 and a tail section 212 of the first mount 210, urges the center portion 244 to move against the lead screw 170 with the threads 244 engaged with the threads 176 while the side portions 242 are in contact with the lead screw 170, as shown in FIG. 8*c*. As such, when the lead screw 170 turns, the engagement mechanism 200, along with the left end 142 of the stop 140, is moved toward the back side 104 or the front side 102 of the buckle chute 100. The engagement mechanism 200 can be disengaged with the lead screw 170 by pushing the second mount 220 toward the first mount 210, as shown in FIG. 8*d,* so as to release the center portion 244 of the split nut 200 from the lead screw 170. As such, the left end 142 of the stop 140 can be disengaged from the lead screw 170, allowing the position of the left end 142 of the stop 140, relative to the entry point 116, to be adjusted. However, when only one of the engagement mechanisms 200, 200' is disengaged from the respective lead screw 170, 172, the stop 140 can only be adjusted to slightly change the angle of the stop 140 with regard to the left and right sides 102, 104. When both of the engagement mechanisms 200, 200' are disengaged from the lead screws 170, 172, the stop 140 can be quickly relocated along the lead screws 170, 172. Thus, with the present invention, the stop 140 can be precisely adjusted in fine steps by using either one of the adjustment knobs 180, 182. The stop 140 can be relocated in one big step by disengaging both engagement mechanisms 200, 200' from the lead screws 70, 72. Furthermore, the position of one end (142 or 144) of the stop 140 can be slightly adjusted, relative to the entry point 116, by disengaging one of the engagement mechanisms 200, 200' from the respective lead screw 170, 172.

It should be noted that the buckle chute 100, according to the present invention, can be used in a folding apparatus to make a folded piece from a single sheet of document or a plurality of sheets. The same buckle chute 100 can also be used to make a folded edge from a folded piece. Furthermore, the buckle chute 100, as described in conjunction with FIGS. 1 to 4*c,* comprises a deflector 112. However, it is not necessary to have a deflector 112 on the buckle chute 100.

Thus, although the invention has been described with respect to a preferred embodiment thereof, it will be understood by those skilled in the art that the foregoing and various other changes, omissions and deviations in the form and detail thereof may be made without departing from the spirit and scope of this invention.

What is claimed is:

1. A buckle chute having a front side, a back side, a first lateral side and a second lateral side for use in a folding apparatus having a first driving mechanism and second driving mechanism for folding at least one sheet of paper having first and second lateral edges defining a width into a folded piece of the same width, the first and the second lateral edges adjacent the first and second lateral sides of the buckle chute, said buckle chute disposed between the first driving mechanism and the second driving mechanism, said buckle chute comprising:

an upper guide and a lower guide for forming a channel having an entry point on the front side of the turn chute adjacent to the first driving mechanism;

a stop, disposed in the channel between the front side and the back side at a separation length from the entry point, for stopping a leading edge of said at least one sheet or the folded piece entering the channel from advancing further into the channel toward the back side, so as to cause said at least one sheet or the folded piece to buckle at a locality thereof outside the entry point of the turn chute toward the second driving mechanism for forming a folded edge at the buckled locality by the second driving mechanism as the first driving mechanism continues driving said at least one sheet or the folded piece toward the buckle chute; and an adjustment mechanism, mechanically engaged with the stop, for moving the stop toward the front side or the back side for adjusting the separation length, wherein the adjustment mechanism comprises a screw system threadably engaged with the stop for relocating the stop, relative to the entry point of the channel wherein the stop has a first end and a second end adjacent to the first lateral side and the second lateral side of the buckle chute, and the screw system comprises a first lead screw disposed near the first lateral side of the buckle chute for operatively engaging with the first end of the stop, and a second lead screw disposed near the second lateral side of the buckle chute for operatively engaging with the second end of the stop, and wherein the first and second lead screws are mechanically linked to each other such that the first and second lead screws can be caused to turn simultaneously for moving both first and second ends of the stop, relatively to the entry point of the channel, by a substantially equal distance for adjusting the separation length.

2. The buckle chute of claim 1, wherein the first end of the stop has an engagement mechanism for threadably engaging with the first lead screw, and the second end of the stop has a further engagement mechanism for threadably engaging with the second lead screw.

3. The buckle chute of claim 2, wherein the engagement mechanism can be disengaged from the first lead screw independently of the further engagement mechanism so as to allow the first end of the stop to be adjusted, relative to the entry point of the channel, independently of the second end of the stop.

4. The buckle chute of claim 2, wherein the engagement mechanism and the further engagement mechanism can both disengaged from the first and second lead screws so as to allow both the first end and the second end of the stop to be relocated, relative to the entry point of the channel.

5. The buckle chute of claim 2, wherein each of the lead screws has threads formed thereon, and the engagement mechanism comprises an engagement member having grooves for engaging with the threads.

6. The buckle chute of claim 5, wherein the engagement mechanism further comprises:

a first mount fixedly mounted to the first end of the stop;

a second mount, movably mounted to the first end of the stop adjacent to the first mount, for fixedly mounting the engagement member, wherein the second mount can be caused to move relative to the first mount to disengage the grooves of the engagement member from the threads of the first lead screw for disengaging the first end of the stop from the first lead screw.

7. The buckle chute of claim 6, wherein the engagement mechanism further comprises a spring mounted between the first mount and the second mount for urging the engagement member against the first lead screw so as to engage the grooves of the engagement member with the threads of the first lead screw.

8. The buckle chute of claim 7, wherein the engagement mechanism further comprises a plurality of guiding members mounted on the first mount adjacent to the engagement member for positioning the engagement mechanism relative to the first lead screw as the spring urges the engagement member against the first lead screw.

9. The buckle chute of claim 1, further comprising a deflector mechanism, disposed near the entry point of the channel and operable in a first position, for allowing the leading edge of said at least one sheet or the folded piece to enter into the channel when said at least one sheet or the folded piece is driven by the first driving mechanism toward the entry point of the channel, or in a second position, for preventing the leading edge of said at least one sheet or the folded piece from entering the charnel and further directing the leading edge toward the second driving mechanism.

* * * * *